US006232720B1

(12) United States Patent
Kitahara et al.

(10) Patent No.: US 6,232,720 B1
(45) Date of Patent: May 15, 2001

(54) HIGH-PRESSURE MERCURY VAPOR DISCHARGE LAMP

(75) Inventors: Yoshiki Kitahara; Nobuyosi Takeuti; Takeharu Tsutsumi, all of Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/135,099

(22) Filed: Aug. 17, 1998

(30) Foreign Application Priority Data

Sep. 4, 1997 (JP) ..... 9-239348

(51) Int. Cl.[7] ..... H01J 17/16

(52) U.S. Cl. ..... 313/634; 313/641; 313/571; 313/631

(58) Field of Search ..... 313/634, 641, 313/637, 620, 25, 635, 640, 642, 638, 490, 571, 639, 574, 631, 573, 576; 315/349, 350, 351

(56) References Cited

U.S. PATENT DOCUMENTS

| | | | | |
|---|---|---|---|---|
| 4,340,844 | | 7/1982 | Tsuchihashi et al. | 315/283 |
| 4,686,419 | | 8/1987 | Block et al. | 313/641 |
| 4,891,555 | * | 1/1990 | Ahlgren et al. | 313/634 |
| 4,988,918 | | 1/1991 | Mori et al. | 313/641 |
| 5,107,178 | * | 4/1992 | Ohyama et al. | 313/639 |
| 5,109,181 | | 4/1992 | Fischer et al. | 313/571 |
| 5,239,232 | * | 8/1993 | Heider et al. | 313/639 |

FOREIGN PATENT DOCUMENTS 0 576 071 A1 12/1993 (EP) .

* cited by examiner

*Primary Examiner*—Nimeshkumar D. Patel
*Assistant Examiner*—Joseph Williams
(74) *Attorney, Agent, or Firm*—Merchant & Gould P.C.

(57) ABSTRACT

A high-pressure mercury vapor discharge lamp comprises an arc tube in which a pair of electrodes are provided and in which a rare gas as a starting gas, a material from which a free halogen is to be produced during a lighting operation, and mercury are enclosed. The arc tube satisfies $X/L \geqq 88$, in which X(W) is a lighting operation power and L (mm) is a distance between the electrodes. The high-pressure mercury vapor discharge lamp satisfies the following expression:

$$1.2 \leqq \phi/(X \times 10^{-2} + 3.2) \leqq 1.6$$

in which $\phi$ (mm) is the inner diameter of the arc tube. Therefore, the high-pressure mercury vapor discharge lamp has a high luminance, a good emission spectrum, and a long life.

12 Claims, 3 Drawing Sheets

HIGH-PRESSURE MERCURY VAPOR DISCHARGE LAMP

FIELD OF THE INVENTION

The present invention relates to a high-pressure mercury vapor discharge lamp used for the back light of an optical instrument such as a liquid crystal projector or an overhead projector.

BACKGROUND OF THE INVENTION

Recently, as the back light of an optical instrument such as a liquid crystal projector or an overhead projector, a projection light source that uses a high-pressure mercury vapor discharge lamp, whose continuous emission in the visible range is increased by increasing the vapor pressure of mercury during lighting to the range of 20 to 35 MPa, combined with a reflecting mirror is known (see Japanese Patent Application (Tokkai Hei) No. 2-148561).

The first requirement for the back light used for a liquid crystal projector or the like is a high luminance. For example, in a high-pressure mercury vapor discharge lamp, the luminance requirement can be satisfied by setting the load input per the unit length of the discharge arc (X/L) to 88 or more, in which X (W) is the lamp power during lighting and L (mm) is the distance between the electrodes. In such a lamp, the lighting life is about 4,000 hours at most. Recently, however, a longer life, that is, a life of 4,000 hours or more, is desired.

In conventional high-pressure mercury vapor discharge lamps, as X is higher and L is shorter, the load input per the unit length of the discharge arc (X/L) increases, in which X (W) is the lamp power during lighting and L (mm) is the distance between the electrodes. Thus, the arc temperature increases. For example, when the lamp is designed with a X/L of 88 or more, the tube wall temperature of the arc tube increases during the lighting life because the arc temperature increases excessively. Also, the arc tube gradually expands during the lighting life because the lighting operation pressure is as high as 10 to 35 MPa. Thus, difficulties are caused. For example, the optical characteristics of the lamp change, and the lamp is damaged by the expansion of the arc tube. Therefore, it is difficult to achieve the life of 4,000 hours or more.

SUMMARY OF THE INVENTION

It is an object of the present invention to provide a high-pressure mercury vapor discharge lamp that has a high luminance, can reduce the expansion of the arc tube and occurrence of damage caused by this expansion, and can achieve a life of 4,000 hours or more.

In order to achieve the above object, the present invention provides a high-pressure mercury vapor discharge lamp comprising an arc tube in which a pair of electrodes are provided and in which a rare gas as a starting gas, a material from which a free halogen is to be produced during a lighting operation, and mercury are enclosed. The arc tube satisfies $X/L \geqq 88$, in which X(W) is a lighting operation power and L (mm) is a distance between the electrodes. The high-pressure mercury vapor discharge lamp satisfies the following expression:

$$1.2 \leqq \phi/(X \times 10^{-2} + 3.2) \leqq 1.6$$

in which $\phi$ (mm) is the maximum inner diameter of the arc tube.

It is preferable that the material from which free halogen is produced is at least one material selected from the group consisting of $CH_2Cl_2$, $CH_2Br_2$, $CH_2I_2$, $CH_3Cl$, $CH_3Br$, $CH_3I$, $CHCl_3$, $CHBr_3$ and $CHI_3$.

It is preferable that the free halogen is present in the arc tube in the range of $10^{-10}$ to $10^{-3}$ mol/cm$^3$ during a lighting operation.

It is preferable that the free halogen is present in the arc tube in the range of $10^{-7}$ to $10^{-5}$ mol/cm$^3$ during a lighting operation.

It is preferable that the free halogen is at least one free halogen selected from the group consisting of Cl, Br and I.

It is preferable that the free halogen is Br.

It is preferable that the rare gas is argon.

It is preferable that the amount of the enclosed mercury is in the range of 100 to 350 mg/cm$^3$ based on the volume of the arc tube.

It is preferable that the vapor pressure of the mercury during lighting is in the range of 10 to 35 MPa.

In the high-pressure mercury vapor discharge lamp of the present invention, the arc tube does not expand at a lighting power of 150 W for up to 4,000 hours.

In the high-pressure mercury vapor discharge lamp of the present invention, damage due to expansion of the arc tube does not occur at a lighting power of 150 W for up to 6,000 hours.

Therefore, the mercury vapor pressure during lighting can be set to 10 to 35 MPa, and an emission spectrum in which red, green and blue components are balanced can be obtained. Also, a high luminance can be achieved by satisfying $X/L \geqq 88$, in which L is the distance between the electrodes, and X is the lighting power. Furthermore, even if the are temperature increases excessively, the increase of the tube wall temperature of the arc tube can be prevented, and the expansion and damage of the arc tube during the lighting life can be prevented. In addition, the upper limit of X/L is about 300.

As described above, the high-pressure mercury vapor discharge lamp of the present invention has a high luminance and can achieve a lighting life of 4,000 hours or more.

DETAILED DESCRIPTION OF THE INVENTION

An embodiment of the present invention will be described below with reference to the drawings.

Figure 1:
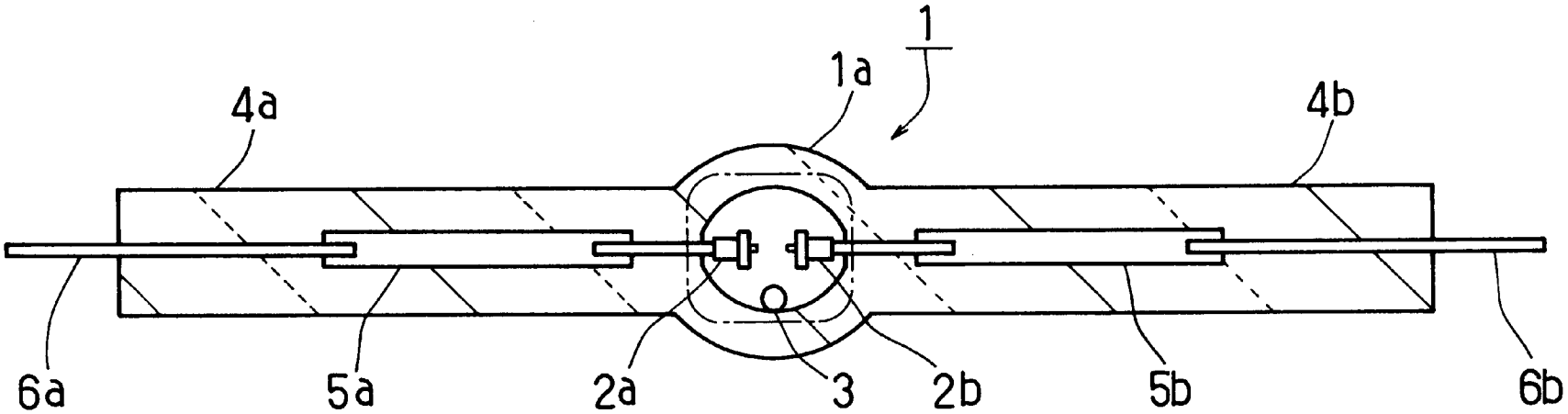
FIG. 1 is an elevation partly in section of a high-pressure mercury vapor discharge lamp in one embodiment of the present invention.

A high-pressure mercury vapor discharge lamp in one embodiment of the present invention as shown in FIG. 1 has a lighting operation power X (W) of 150 W and comprises an arc tube 1 made of quartz having a light-emitting portion 1*a* and sealing portions 4*a* and 4*b* continuously provided at both ends of the light-emitting portion 1*a*. In the light-emitting portion 1*a*, the inner diameter $\phi$ (mm) as shown in FIG. 2 was 6.5 mm, and $\phi/(X \times 10^{-2} + 3.2)$ was 1.4.

Figure 2:
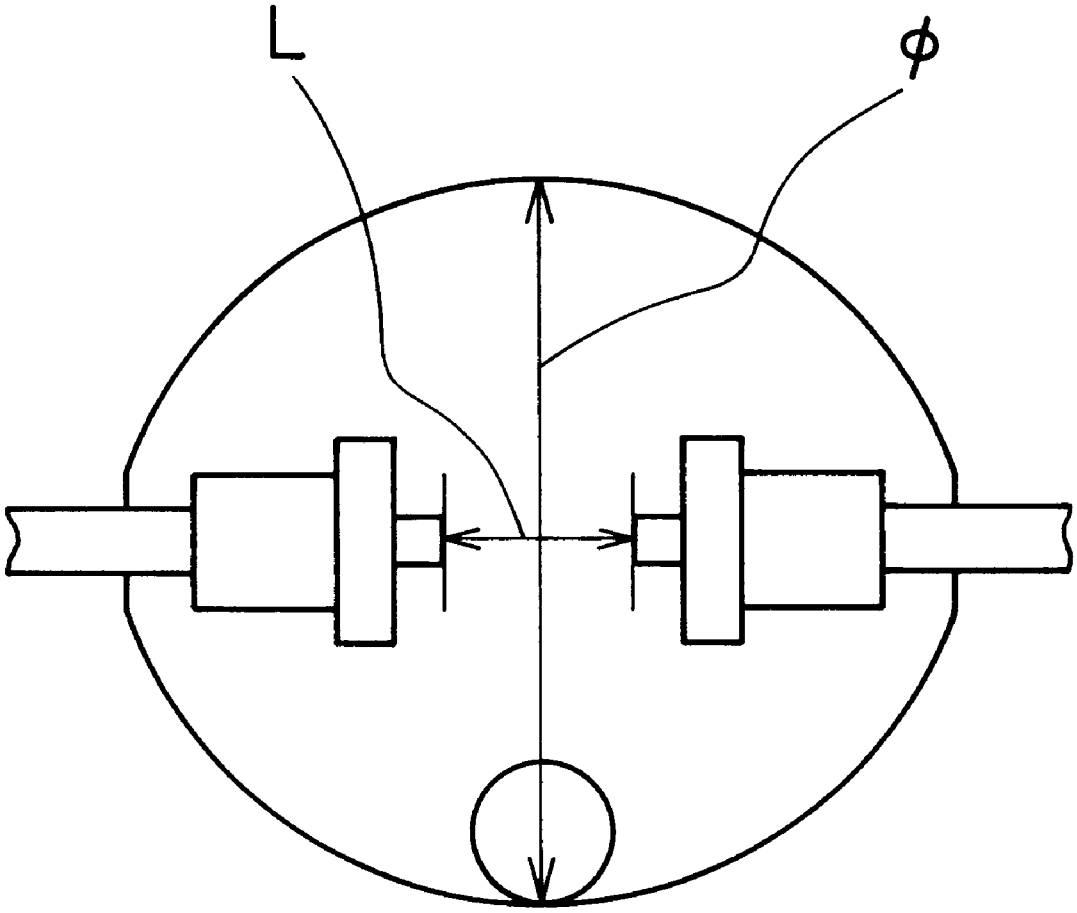
FIG. 2 is an enlarged view of the portion shown by the alternating long and short dash line in FIG. 1.

Inside the arc tube 1, a pair of electrodes 2*a* and 2*b* made of tungsten were provided with the distance between the electrodes as shown in FIG. 2 being 1.5 mm so that X/L was 100. Also, inside the arc tube 1, mercury 3 was enclosed at a density of 200 mg/cm$^3$, an argon gas as a starting rare gas was enclosed at 100 hPa, and $CH_2Br_2$ as a material from which a halogen was to be liberated during a lighting operation was enclosed at a density of $1\times10^{-7}$ mol/Cm$^3$.

$CH_2Br_2$ was decomposed during the lighting operation of the lamp so that Br was present in the arc tube 1 at a density of $2\times10^{-7}$ mol/Cm$^3$. Also, metal foils 5*a* and 5*b* made of molybdenum connected to the electrodes 2*a* and 2*b* were hermetically sealed in the sealing portions 4*a* and 4*b* so that the electrodes 2*a* and 2*b* were located in the light-emitting portion 1*a*. One end of outer leads 6*a* and 6*b* was connected to the metal foils 5*a* and 5*b* respectively, and the other end of the outer leads 6*a* and 6*b* was led out of the arc tube 1 respectively.

Ten of the high-pressure mercury vapor discharge lamps in this embodiment (hereinafter referred to as the articles of the present invention) were subjected to a lighting life test at a lighting operation power of 150 W. As a result, the arc tubes hardly expanded for up to 4,000 hours, and damage due to the expansion of the arc tubes did not occur even after 6,000 hours.

Next, the presence or absence of damage to arc tubes in the articles of the present invention having various X, L and ϕ (Samples 1 to 5) was measured. The results are shown in Table 1. Ten of each of these high-pressure mercury vapor discharge lamps were subjected to a lighting life test.

TABLE 1

| | Sample 1 | Sample 2 | Sample 3 | Sample 4 | Sample 5 |
|---|---|---|---|---|---|
| X *1) | 150 | 120 | 180 | 250 | 250 |
| L *2) | 1.5 | 0.8 | 1.7 | 2.0 | 2.0 |
| ϕ *3) | 5.2 | 5.3 | 7.5 | 9.0 | 9.7 |
| P *4) | 1.1 | 1.2 | 1.5 | 1.6 | 1.7 |
| Hg(mg/cm$^3$) | 200 | 350 | 160 | 100 | 100 |
| Damage to arc tube | present | absent | absent | absent | absent |
| Initial properties *5) | ○ | ○ | ○ | ○ | X |
| Long life *6) | X | ○ | ○ | ○ | ○ |
| Total evaluation | X | ○ | ○ | ○ | X |

Note:
*1) X indicates a lighting operation power (watt).
*2) L indicates a distance between the electrodes (mm).
*3) ϕ indicates the inner diameter of the arc tube.
*4) P indicates $\phi/(X \times 10^{-2} + 3.2)$.
*5) For initial properties, the emission spectrum and the total luminous flux were measured by the integrating sphere, and the balance of red, green and blue components in the emission spectrum and the efficiency during the stable lighting of the lamp were evaluated. In visual evaluation, ○ indicates that color reproducibility was good, and X indicates that green color was noticeable and that color reproducibility was not good as a whole.
*6) For long life, a lighting life test was conducted at the lighting operation power X (W), and the light was repeatedly turned on for 3.5 hours and turned off for 0.5 hour. The long life was determined by the presence or absence of damage to the arc tube after 4,000 hours. ○ indicates the absence of damage, and X indicates the presence of damage.

As is apparent from Table 1, in the high-pressure mercury vapor discharge lamps of Sample 2, the arc tubes slightly expanded but were not damaged for 4,000 hours. In the high-pressure mercury vapor discharge lamps of Samples 3 and 4, the arc tubes hardly expanded for up to 4,000 hours, and damage due to the expansion of the arc tubes did not occur even after 6,000 hours.

In the high-pressure mercury vapor discharge lamps of Samples 2 to 4 as shown in Table 1, the mercury vapor pressure could be set to 10 to 35 MPa during lighting, and an emission spectrum in which red, green and blue were balanced was obtained. Also, a high luminance was achieved by satisfying $X/L \geqq 88$.

When P was 1.1 or less as in Sample 1, the tube wall temperature of the arc tubes increased because ϕ was small with respect to X. Therefore, about 20% of the lamps were damaged by the expansion of the arc tubes for 4,000 hours of lighting. Also, the life of the lamps was about the same as that of conventional high-pressure mercury vapor discharge lamps. When P was 1.7 or more as in Sample 5, a coolest portion where mercury cohered was formed on the wall of the arc tubes even during lighting because ϕ was large with respect to X. Therefore, difficulties occurred, for example, the emission intensity decreased.

When lamps in which halogens Cl, Br and I were enclosed in the range of $10^{-10}$ to $10^{-3}$ mol/cm$^3$ in the arc tubes 1 satisfying $1.2 \leqq P \leqq 1.6$ as shown in Table 1 were subjected to the lighting life test, blackening was hardly observed within 4,000 hours of lighting. Significant blackening did not occur in the lamps lighted for up to 6,000 hours, and the lamps in which halogens Cl, Br and I were enclosed in the range of $10^{-7}$ to $10^{-5}$ mol/cm$^3$ especially showed good results. This was because tungsten, which was evaporated from the electrodes during the lamp lighting, was returned to the electrodes without being attached to the inner wall of the arc tube due to the halogen cycle, preventing the blackening of the inner wall of the arc tube. Among the halogens Cl, Br and I, Br was most effective for preventing the blackening of the inner wall of the arc tube.

Furthermore, similar effects were obtained when any one of $CH_2Cl_2$, $CH_2I_2$, $CH_3Cl$, $CH_3Br$, $CH_3I$, $CHCl_3$, $CHBr_3$ and $CHI_3$ was used instead of $CH_2Br_2$ in the high-pressure mercury vapor discharge lamps in the above embodiment.

Figure 3:
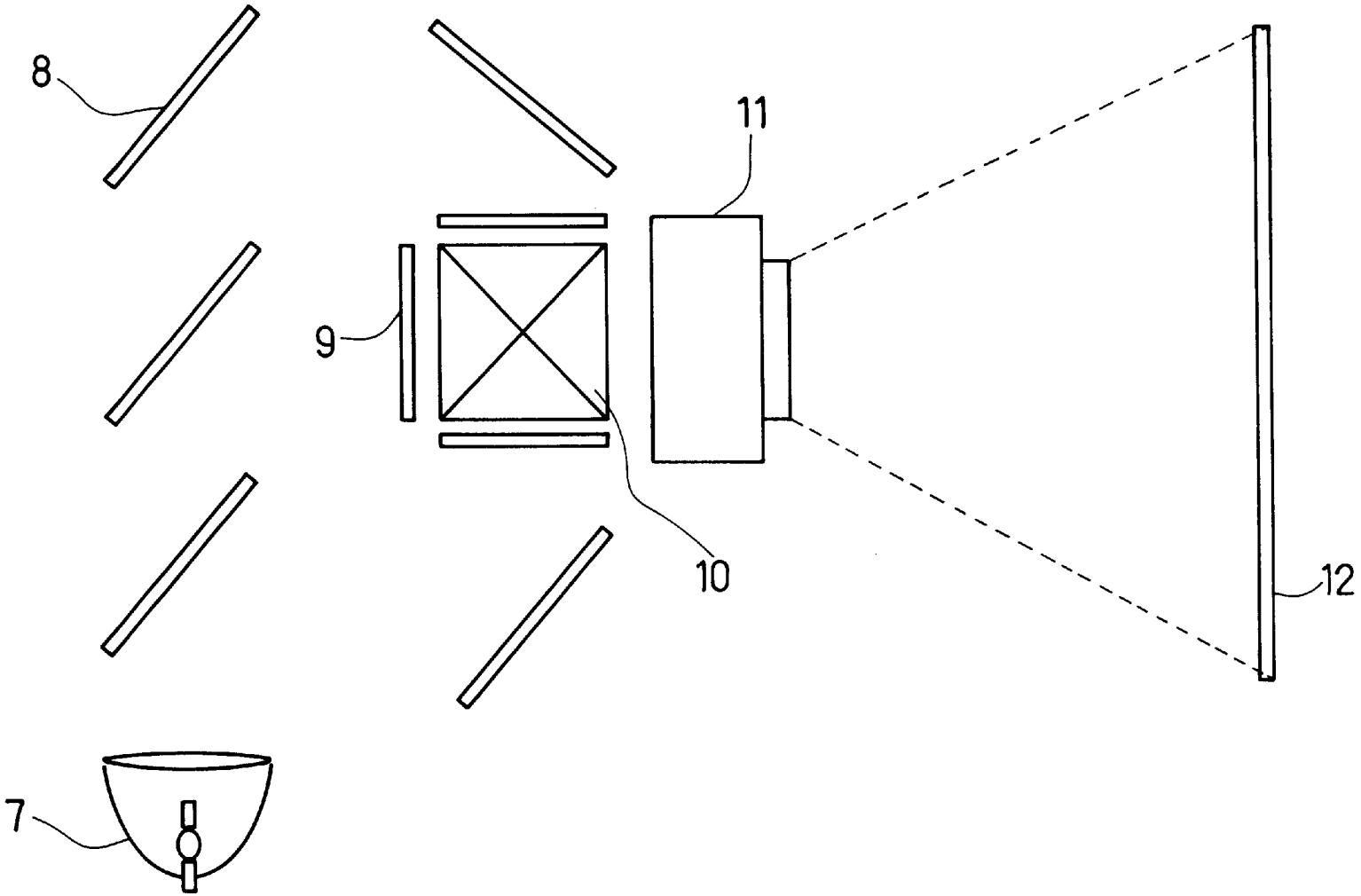
FIG. 3 is a schematic view of a liquid crystal projector using the high-pressure mercury vapor discharge lamp in one embodiment of the present invention.

As shown in FIG. 3, when the arc tube of the present invention was incorporated into a commercial liquid crystal projector as a light source, preferable results for life, luminance, emission spectrum, and the like, were obtained. In this liquid crystal projector, light is emitted from a light source 7 using the arc tube of the present invention, refracted and gathered in a constant direction by a plurality of mirrors 8 to project images on an LCD 9 onto a screen 12 through a prism 10 and a projection lens 11.

The invention may be embodied in other forms without departing from the spirit or essential characteristics thereof The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A high-pressure mercury vapor discharge lamp comprising: an arc tube in which a pair of electrodes are provided and in which a rare gas as a starting gas, a material from which a free halogen is to be produced during the lighting operation, and mercury are enclosed, the arc tube satisfying $X/L \geqq 88$, in which X (W) is a lighting operation power and L (mm) is a distance between the electrodes, wherein the high pressure mercury vapor discharge lamp satisfies the following expression:

$$1.2 \leqq \phi/(X\times10^{-2}+3.2) \leqq 1.6$$

in which ϕ (mm) is a maximum inner diameter of the arc tube and, wherein the free halogen is present in the range of $10^{-7}$ to $10^{-5}$ mol/cm$^3$ during the lighting operation.

2. The high-pressure mercury vapor discharge lamp according to claim 1, wherein the material is at least one material selected from the group consisting of $CH_2Cl_2$, $CH_2Br_2$, $CH_2I_2$, $CH_3Cl$, $CH_3Br$, $CH_3I$, $CHCl_3$, $CHBr_3$ and $CHI_3$.

3. The high-pressure mercury vapor discharge lamp according to claim 1, wherein the free halogen is at least one free halogen selected from the group consisting of Cl, Br and I.

4. The high-pressure mercury vapor discharge lamp according to claim 3, wherein the free halogen is Br.

5. The high-pressure mercury vapor discharge lamp according to claim 1, wherein the rare gas is argon.

6. The high-pressure mercury vapor discharge lamp according to claim 1, wherein an amount of the enclosed mercury is in the range of 100 to 350 mg/cm$^3$ based on the volume of the arc tube.

7. The high-pressure mercury vapor discharge lamp according to claim 1, wherein a vapor pressure of the mercury during lighting is in the range of 10 to 35 MPa.

8. The high-pressure mercury vapor discharge lamp according to claim 1, wherein the arc tube does not expand at a lighting power of 150 W for up to 4,000 hours.

9. The high-pressure mercury vapor discharge lamp according to claim 1, wherein damage due to expansion of the arc tube does not occur at a lighting power of 150 W for up to 6,000 hours.

10. An optical instrument having a backlight, which comprises a high-pressure mercury discharge lamp comprising: an arc tube in which a pair of electrodes are provided and in which a rare gas as a starting gas, a material from which a free halogen is to be produced during the lighting operation, and mercury are enclosed, the arc tube satisfying $X/L \geqq 88$, in which X (W) is a lighting operation power and L (mm) is a distance between the electrodes, wherein the high pressure mercury vapor discharge lamp satisfies the following expression:

$$1.2 \leqq \phi/(X \times 10^{-2} + 3.2) \leqq 1.6$$

in which $\phi$ (mm) is a maximum inner diameter of the arc tube and, wherein the free halogen is present in the range of $10^{-7}$ to $10^{-5}$ mol/cm$^3$ during the lighting operation.

11. An optical instrument as claimed in claim 10, wherein the optical instrument is an overhead projector.

12. An optical instrument as claimed in claim 10, wherein the optical instrument is a liquid crystal projector.

* * * * *